US010946433B2

(12) United States Patent
Nishizawa et al.

(10) Patent No.: US 10,946,433 B2
(45) Date of Patent: Mar. 16, 2021

(54) MANUFACTURING APPARATUS FOR HEAT EXCHANGER FINS

(71) Applicant: HIDAKA SEIKI KABUSHIKI KAISHA, Tokyo (JP)

(72) Inventors: Junichi Nishizawa, Tokyo (JP); Keiichi Morishita, Tokyo (JP)

(73) Assignee: HIDAKA SEIKI KABUSHIKI KAISHA, Tokyo (JP)

( * ) Notice: Subject to any disclaimer, the term of this patent is extended or adjusted under 35 U.S.C. 154(b) by 196 days.

(21) Appl. No.: 16/300,150

(22) PCT Filed: Oct. 20, 2016

(86) PCT No.: PCT/JP2016/081055
§ 371 (c)(1),
(2) Date: Nov. 9, 2018

(87) PCT Pub. No.: WO2018/073929
PCT Pub. Date: Apr. 26, 2018

(65) Prior Publication Data

US 2019/0143394 A1 May 16, 2019

(51) Int. Cl.
*B21D 53/08* (2006.01)
*B21D 43/06* (2006.01)

(52) U.S. Cl.
CPC ..... *B21D 53/08* (2013.01); *B21D 43/06* (2013.01)

(58) Field of Classification Search
CPC ..... B21D 53/08; B21D 43/06; B21D 43/22; B21D 53/025; B21D 37/10; B21D 43/08;
(Continued)

(56) References Cited

U.S. PATENT DOCUMENTS 5,349,841 A 9/1994 Honma et al.
6,398,482 B2 * 6/2002 Asano ..... B23P 15/26 414/790.3

(Continued)

FOREIGN PATENT DOCUMENTS

JP 6-198367 A 7/1994
JP 2003-320433 A 11/2003

(Continued)

OTHER PUBLICATIONS

Korean Office Action for Korean Application No. 10-2018-7035363, dated Feb. 4, 2020, with English translation.

(Continued)

*Primary Examiner* — Sarang Afzali
(74) *Attorney, Agent, or Firm* — Birch, Stewart, Kolasch & Birch, LLP

(57) ABSTRACT

Conveying of a molded body for heat exchanger fins at a high speed to prevents deformation of the molded body for heat exchanger fins and the generation of noise. A molding apparatus forms a plurality of cutaway portions at different positions on each molded body of the product width. A rotational shaft is provided that extends in the width direction and has a plurality of rotating discs that have a plurality of tapered protrusions, which are capable of advancing into the cutaway portions, formed on an outer circumferential surface thereof provided on the rotational shaft for each molded body for heat exchanger fins of the product width. When the plurality of cutaway portions of the molded bodies for heat exchanger fins of the product width, on which the plurality of cutaway portions has different positions, are disposed directly above the rotational shaft, the protrusions advance into the cutaway portions.

4 Claims, 9 Drawing Sheets

(58) Field of Classification Search
CPC ..... B21D 53/022; F28F 1/12; F28F 2215/08; B23P 15/26; Y10T 29/53113; B65H 20/22
See application file for complete search history.

(56) References Cited

U.S. PATENT DOCUMENTS

| | | | | |
|---|---|---|---|---|
| 9,199,346 | B2 * | 12/2015 | Karasawa | B21D 43/22 |
| 9,259,776 | B2 * | 2/2016 | Morishita | B21D 53/022 |
| 9,358,603 | B2 * | 6/2016 | Shiozawa | B21D 53/08 |
| 9,987,673 | B2 * | 6/2018 | Karasawa | B21D 28/002 |
| 2012/0216664 | A1 | 8/2012 | Shiozawa et al. | |
| 2012/0222293 | A1 | 9/2012 | Ueda et al. | |
| 2013/0160516 | A1 | 6/2013 | Karasawa et al. | |
| 2019/0106285 | A1 * | 4/2019 | Nishizawa | B65H 20/20 |

FOREIGN PATENT DOCUMENTS

| | | | |
|---|---|---|---|
| JP | 2006-21876 | A | 1/2006 |
| JP | 2008-121921 | A | 5/2008 |
| JP | 2012-183554 | A | 9/2012 |
| JP | 2013-110232 | A | 6/2013 |
| KR | 10-2012-0091298 | A | 8/2012 |
| KR | 10-2013-0079178 | A | 7/2013 |

OTHER PUBLICATIONS

International Search Report, issued in PCT/JP2016/081055, dated Dec. 6, 2016.

* cited by examiner

B-B CROSS SECTION

C-C CROSS SECTION

MANUFACTURING APPARATUS FOR HEAT EXCHANGER FINS

TECHNICAL FIELD

The present invention relates to a manufacturing apparatus for heat exchanger fins equipped with a conveying apparatus which conveys a molded body for heat exchanger fins including a plurality of through-holes or cutaway portions.

BACKGROUND ART

A heat exchanger, such as an air conditioner, is typically constructed by stacking a plurality of heat exchanger fins, in which a plurality of through-holes or cutaway portions have been formed to enable heat exchanger tubes to be inserted.

Such heat exchanger fins can be manufactured by a manufacturing apparatus for heat exchanger fins such as that depicted in FIG. 11.

The manufacturing apparatus for heat exchanger fins 200 is equipped with an uncoiler 212, in which a thin metal plate 210 made of aluminum or the like as a thin plate material has been wound into a coil. The thin metal plate 210 pulled out from the uncoiler 212 via pinch rollers 214 is inserted into an oil applying apparatus 216 where machining oil is applied onto the surface of the thin metal plate 210, and is then supplied to a mold apparatus 220 provided inside a mold pressing unit 218.

The mold apparatus 220 internally includes an upper mold die set 222 that is capable of up-down movement and a lower mold die set 224 that is static. The mold apparatus 220 forms a plurality of collar-equipped through-holes or cutaway portions, where collars of a predetermined height are formed around through-holes, at predetermined intervals (in a matrix-like arrangement) in a predetermined direction.

The result of machining the thin metal plate 210 to produce the through-holes or cutaway portions and the like is hereinafter referred to as the "metal strip 211".

The metal strip 211 that has been machined is formed in a state where a plurality of heat exchanger fins as products are aligned in the width direction.

For this reason, an inter-row slit apparatus 225 is provided at a position downstream of the mold apparatus 220. The inter-row slit apparatus 225 cuts the metal strip 211, which is intermittently fed by a feeding apparatus 226 after formation by the mold pressing unit 218, into a predetermined product width using upper blades 225A and lower blades 225B that come together to form metal strips of the product width 211A in the form of strips that are long in the conveying direction.

The metal strips of the product width 211A formed by the inter-row slit apparatus 225 are cut into predetermined product lengths by a cutter 227 and thereby formed into heat exchanger fins 213 that are the intended product to be manufactured. The heat exchanger fins 213 formed in this way are stored in a stacker 228. The stacker 228 has a plurality of pins 229 that are erected in the vertical direction, and the heat exchanger fins 213 are stacked and held in the stacker 228 by inserting the pins 229 into the through-holes or the cutaway portions that have been formed in the heat exchanger fins 213.

CITATION LIST

Patent Literature

Patent Literature 1: Japanese Laid-open Patent Publication No. 2006-21876

SUMMARY OF INVENTION

Technical Problem

The feeding apparatus 226 in the conventional manufacturing apparatus for heat exchanger fins 200 conveys the metal strip 211 that has been molded by the mold apparatus 220 (the mold pressing unit 218) using an intermittent feeding mechanism called a "hitch feeding mechanism".

With an intermittent feeding mechanism as represented by a hitch feeding mechanism, it is necessary to insert the hitch pins into the metal strip 211 when conveying the metal strip 211 and to withdraw the hitch pins from the metal strip 211 when returning the hitch feeding mechanism from the conveying direction of the metal strip 211, which results in a limit for high-speed conveying of the metal strip 211.

Also, when attempting to perform high-speed conveying of the metal strip 211 using a hitch feeding mechanism, collisions between the components constructing the hitch feeding mechanism generate noise and risk damaging the components constructing the hitch feeding mechanism.

The present invention was conceived to solve the above problem and has objects of enabling high-speed conveying of a molded body for heat exchanger fins that has been molded by a mold apparatus and, by conveying stably and with high precision, of preventing deformation of the molded body for heat exchanger fins and the generation of noise when conveying the molded body for heat exchanger fins.

Solution to Problem

A manufacturing apparatus for heat exchanger fins according to the present invention manufactures heat exchanger fins which have a plurality of through-holes or cutaway portions, into which heat exchanger tubes are to be inserted, formed along a length direction thereof, the manufacturing apparatus including: a mold apparatus that forms, in a thin plate made of metal, a molded body for heat exchanger fins which has a plurality of heat exchanger fins, in which the plurality of through-holes or the plurality of cutaway portions have been formed, formed in a width direction; a conveying apparatus that conveys the molded body for heat exchanger fins in a conveying direction; and an inter-row slit apparatus that cuts the molded body for heat exchanger fins along the conveying direction to produce molded bodies for heat exchanger fins of a product width. The mold apparatus is provided so as to form, in the molded body for heat exchanger fins to be formed in the thin plate made of metal, the molded body for heat exchanger fins so that the plurality of through-holes or cutaway portions have different positions in the conveying direction for each molded body for heat exchanger fins of the product width. The conveying apparatus is provided with a single rotational shaft that extends in the width direction that is perpendicular to the conveying direction on a horizontal plane, has a plurality of rotating discs that have a plurality of tapered protrusions, which are capable of advancing into the through-holes or cutaway portions, formed on an outer circumferential surface thereof provided on the rotational shaft along an axial direction of the rotational shaft so that a number of the rotating discs is equal to a number of the molded bodies for heat exchanger fins of the product width, and includes a rotational driving unit that rotationally drives the rotational shaft. Positions of the protrusions on different rotating discs out of the rotating discs have a predetermined angular phase difference so that the protrusions advance into the through-holes or cutaway portions when the plurality of through-holes or cutaway portions of the molded bodies for heat exchanger fins of the product width, for which the positions in the conveying direction of the plurality of through-holes or cutaway portions differ, are disposed directly above the rotational shaft.

By using the above configuration, since it is not necessary to use a hitch feeding mechanism, it is possible to avoid the generation of noise and damage to components, and to convey a molded body for heat exchanger fins at high speed. It is also possible to have protrusions advance into and convey each molded body for heat exchanger fins of the product width even when a plurality of molded bodies for heat exchanger fins of the product width of different shapes have been molded on one thin plate made of metal. Here, since the conveying apparatus has only one rotational shaft, it is possible to achieve a reduction in size compared to when the conveying apparatus has a plurality of rotational shafts.

The manufacturing apparatus may also include a lower guide plate that supports a lower surface of the molded body for heat exchanger fins and an upper guide plate that covers an upper surface of the molded body for heat exchanger fins.

With this configuration, it is possible to avoid fluctuations in the thickness direction of the molded body for heat exchanger fins during conveying of the molded body for heat exchanger fins. It is also possible to keep the insertion depth of the protrusions into the cutaway portions formed in the molded body for heat exchanger fins constant, which makes it possible to stably convey the molded body for heat exchanger fins.

Also, during intermittent feeding of the molded body for heat exchanger fins, when the rotating conveyor driving unit has completed an operation in one cycle, the protrusions may be inserted in a direction perpendicular to a conveying plane at at least one position out of the through-holes or cutaway portions of the molded body for heat exchanger fins.

With this configuration, since the protrusions are inserted inside the through-holes or cutaway portions at the start of a next operation, it is possible for the rotating discs to reliably convey the molded body for heat exchanger fins.

Also, a value produced by dividing an angular interval at which the protrusions are disposed on each rotating disc by a number of groups of rotating discs that have a same angular phase difference may be no greater than 14 degrees.

With this configuration, it is possible, before protrusions formed on the rotating discs that have advanced into the through-holes or cutaway portions are gradually withdrawn from the through-holes or cutaway portions due to rotation of the rotating discs so as to become no longer able to perform positioning, for the next protrusions to advance into and newly position the through-holes or cutaway portions. That is, it is possible to improve product quality and to convey at high speed.

Advantageous Effects of Invention

According to the present invention, it is possible to enable high-speed conveying of a molded body for heat exchanger fins and, by conveying stably and with high precision, to prevent deformation of the molded body for heat exchanger fins and the generation of noise when conveying the molded body for heat exchanger fins.

DESCRIPTION OF EMBODIMENTS

Figure 1:
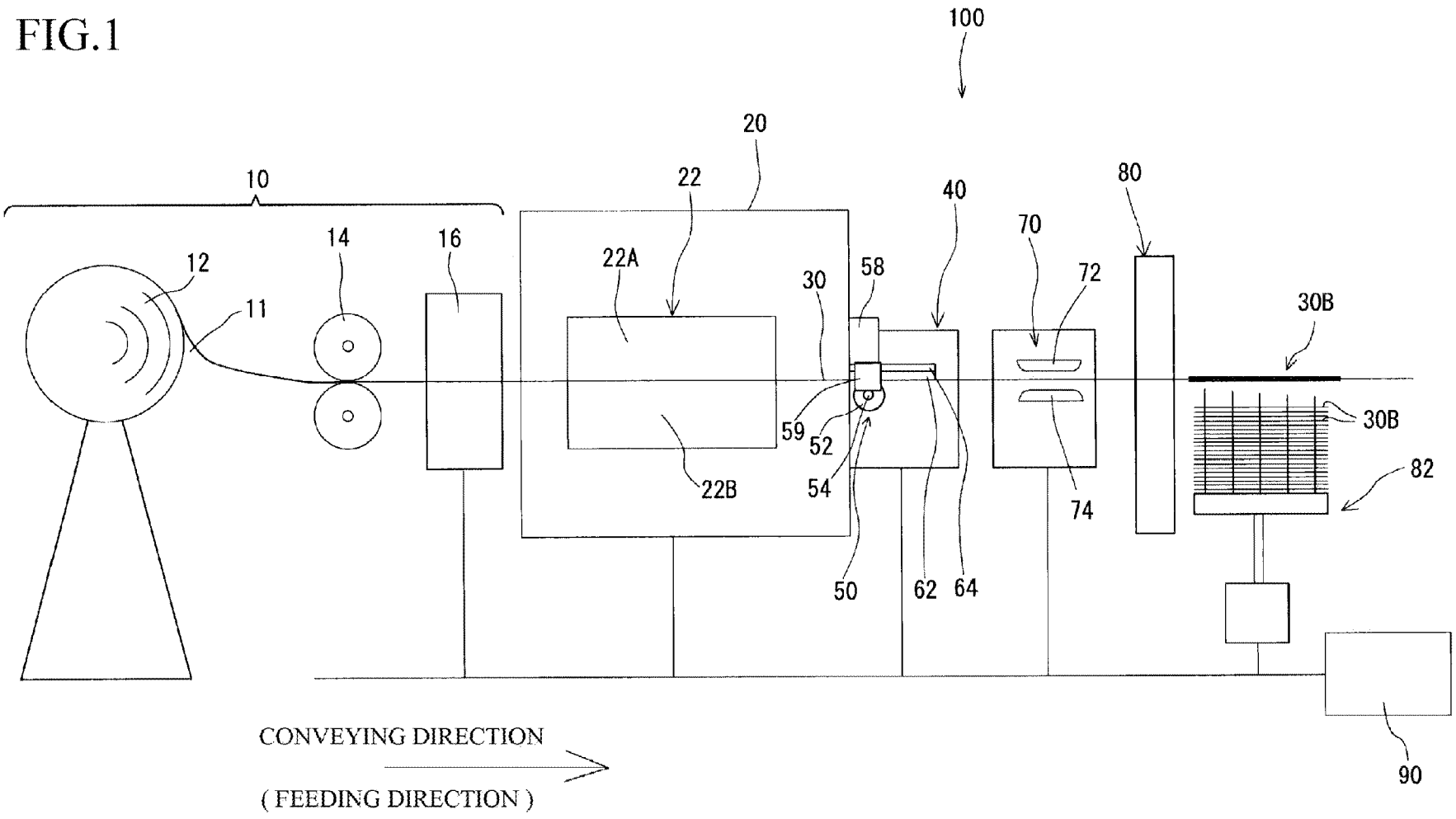
FIG. 1 is a side view depicting the overall configuration of a manufacturing apparatus for heat exchanger fins.

The overall configuration of a manufacturing apparatus for heat exchanger fins 100 is depicted in FIG. 1.

Here, the concept of a "molded body for heat exchanger fins" refers to any of a metal strip obtained by press machining a thin metal plate 11 using a mold pressing unit 20 and a metal strip of product width produced by dividing such metal strip into the product width of heat exchanger fins. In other words, the expression "molded body for heat exchanger fins" refers to a metal strip in a state after cutaway portions have been formed in the thin metal plate 11 but before cutting into predetermined lengths in the conveying direction.

Cutting a molded body for heat exchanger fins of the product width into product lengths produces heat exchanger fins as products.

A thin metal plate 11, which is unmachined and is made of aluminum or the like that is the material for a molded body for heat exchanger fins, is wound into a coil in an uncoiler 12. The thin metal plate 11 pulled out from the uncoiler 12 is pulled out via pinch rollers 14, has machining oil applied to it by an oil applying apparatus 16, and is then intermittently fed to a mold pressing unit 20 that has a mold apparatus 22 disposed inside. With this configuration, a material supplying unit 10 is constructed by the uncoiler 12, the pinch rollers 14, and the oil applying apparatus 16. Note that this configuration of the material supplying unit 10 is a mere example, and the configuration of the material supplying unit 10 is not limited to the configuration described in this embodiment.

The mold apparatus 22 in the present embodiment includes an upper mold die set 22A and a lower mold die set 22B, with the upper mold die set 22A being provided so as to be capable of moving toward and away from the lower mold die set 22B. In the mold pressing unit 20 that includes the mold apparatus 22, a molded body for heat exchanger fins 30, which has tube insertion portions 31 as cutaway portions for inserting flattened tubes for heat exchanging, is formed in the thin metal plate 11.

Figure 2:
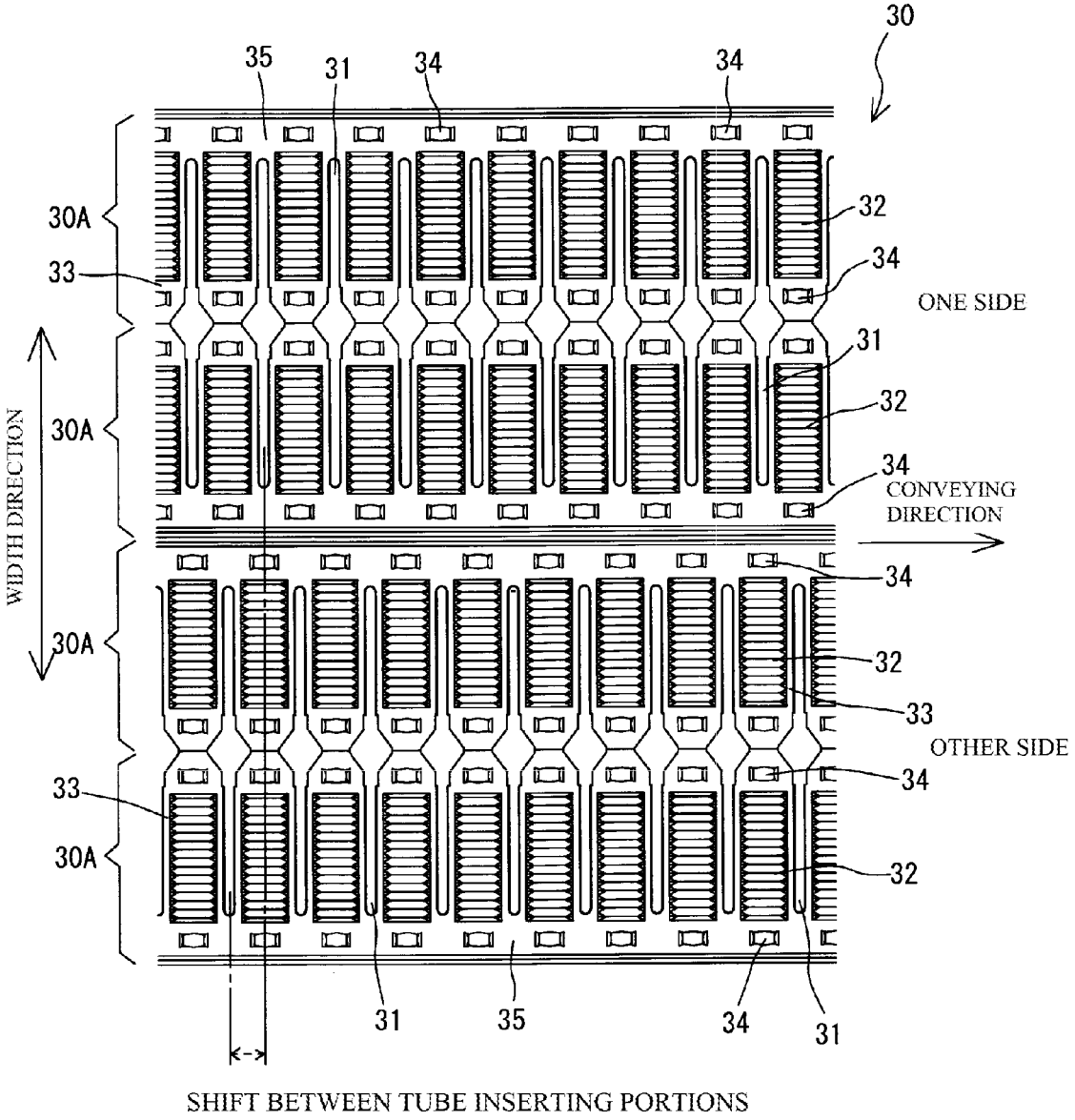
FIG. 2 is a plan view of a molded body for heat exchanger fins.

The molded body for heat exchanger fins 30 formed by the mold apparatus 22 is depicted in FIG. 2.

The molded body for heat exchanger fins 30 depicted in FIG. 2 has a plurality of "molded bodies for heat exchanger fins of the product width 30A" formed in a line in a width direction (the up-down direction in the plane of FIG. 2) that is perpendicular to a predetermined conveying direction (the rightward direction in the plane of FIG. 2) on a horizontal plane.

The molded body for heat exchanger fins 30 is continuous in the conveying direction and in the direction that is perpendicular to the conveying direction on the horizontal plane, with FIG. 2 depicting only an extracted part of the molded body for heat exchanger fins 30.

The individual molded bodies for heat exchanger fins of the product width 30A each have a plurality of tube inserting portions 31, into which flattened tubes for circulating a heat exchanger medium will be inserted, formed at a plurality of positions.

Plate-like portions 33, where louvers 32 are formed, are formed between the respective tube inserting portions 31. Folded-up portions 34 formed by cutting and folding up parts of the plate-like portions 33 are also formed at both ends in the width direction of the louvers 32.

Out of the two folded-up portions 34 formed for one louver 32, one folded-up portion 34 is formed at a front end-side of the plate-like portion 33.

The tube inserting portions 31 are formed from only one side in the width direction of the molded bodies for heat exchanger fins of the product width 30A. Accordingly, the plurality of plate-like portions 33 between the respective tube inserting portions 31 are joined by a joining portion 35 that extends in the length direction.

Out of the two folded-up portions 34 for one louver 32 described above, the folded-up portion 34 on the other side is formed on the joining portion 35. Note that out of the parts of the plate-like portions 33 and the joining portion 35 that are not subjected to press-machining, parts that are continuous in the conveying direction of the molded body for heat exchanger fins 30 are regarded as "flat parts of the molded body for heat exchanger fins 30" (and referred to sometimes simply as "flat parts" in the following description).

On the molded body for heat exchanger fins 30 depicted in FIG. 2, two molded bodies for heat exchanger fins of the product width 30A are disposed with the open ends of the tube inserting portions 31 adjacent to one another to form a pair, and two of such pairs are formed. That is, the pairs, in which the open ends of the tube inserting portions 31 of two products are disposed facing one another, are disposed so that the joining portions 35 thereof are adjacent.

Also, the molding positions in the conveying direction differ between one pair of molded bodies for heat exchanger fins of the product width 30A disposed so that the open ends of the tube inserting portions 31 face one another positioned on one side in the width direction (the upper side in FIG. 2) of the molded body for heat exchanger fins 30 and another pair of molded bodies for heat exchanger fins of the product width 30A positioned on the other side in the width direction (the lower side in FIG. 2).

In the present embodiment, the pairs of molded bodies for heat exchanger fins of the product width 30A are respectively shifted by a half pitch, so that the tube inserting portions 31 in each pair are positioned at the center in the conveying direction of the plate-like portions 33 in the other pair.

Although a case where the molding positions are shifted for the pair of molded bodies for heat exchanger fins of the product width 30A on one side and the pair of molded bodies for heat exchanger fins of the product width 30A on the other side when manufacturing heat exchanger fins of the same shape will be described with reference to FIG. 2, it is also possible to apply the present invention to a case when manufacturing heat exchanger fins of different shapes on one side and the other side.

The description will now return to the overall configuration of the manufacturing apparatus for heat exchanger fins 100. The molded body for heat exchanger fins 30 formed in the mold apparatus 22 housed in the mold pressing unit 20 is conveyed intermittently in a predetermined direction (here, toward an inter-row slit apparatus 70) by a conveying apparatus 40 which is provided downstream of the mold pressing unit 20.

The feed timing of the conveying apparatus 40 is subjected to operation control by an operation control unit 90, described later, so as to operate in synchronization with (in concert with) operations of the mold pressing unit 20, and enables stable intermittent feeding.

Figure 3:
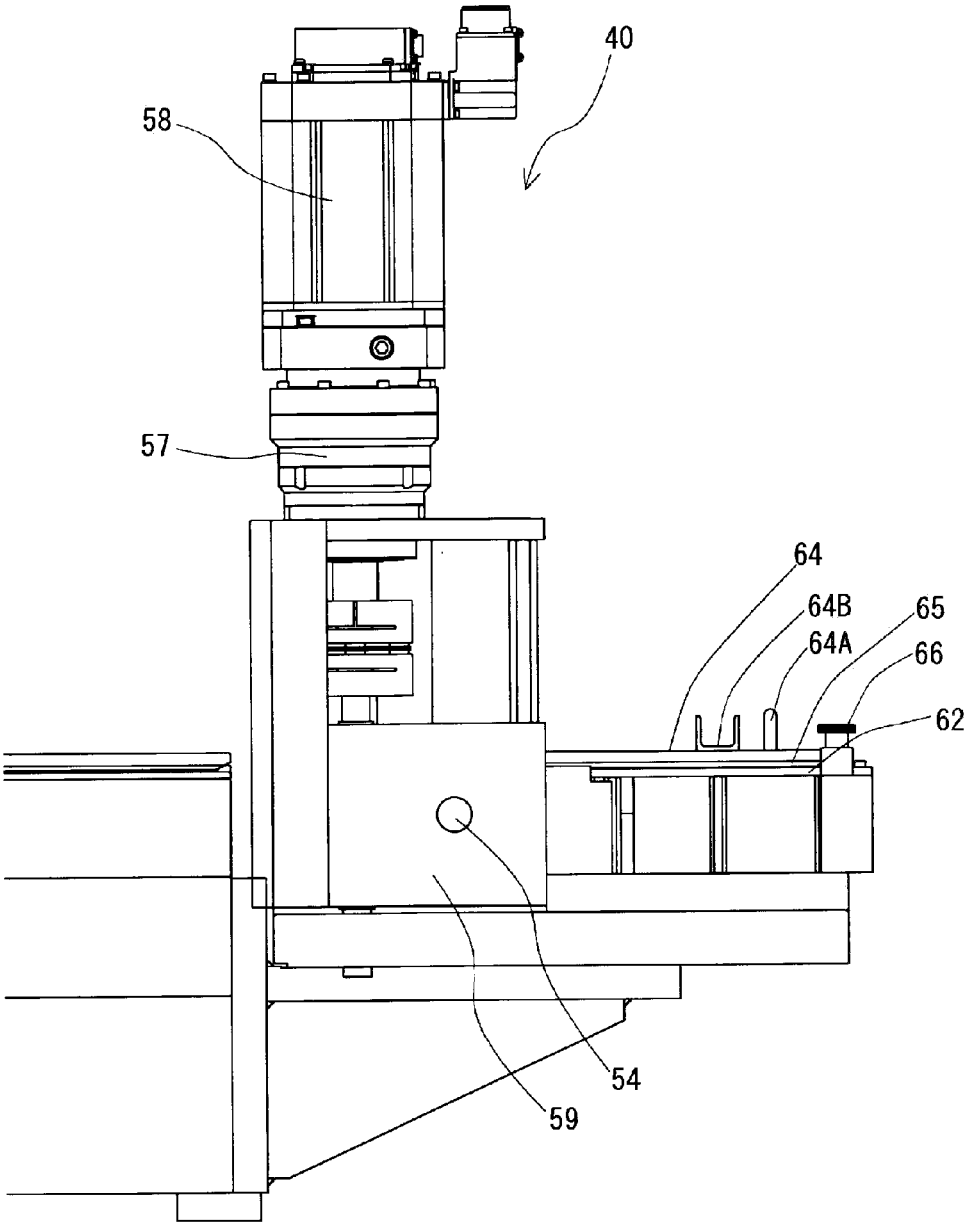
FIG. 3 is a side view of a conveying apparatus according to a first embodiment.
Figure 4:
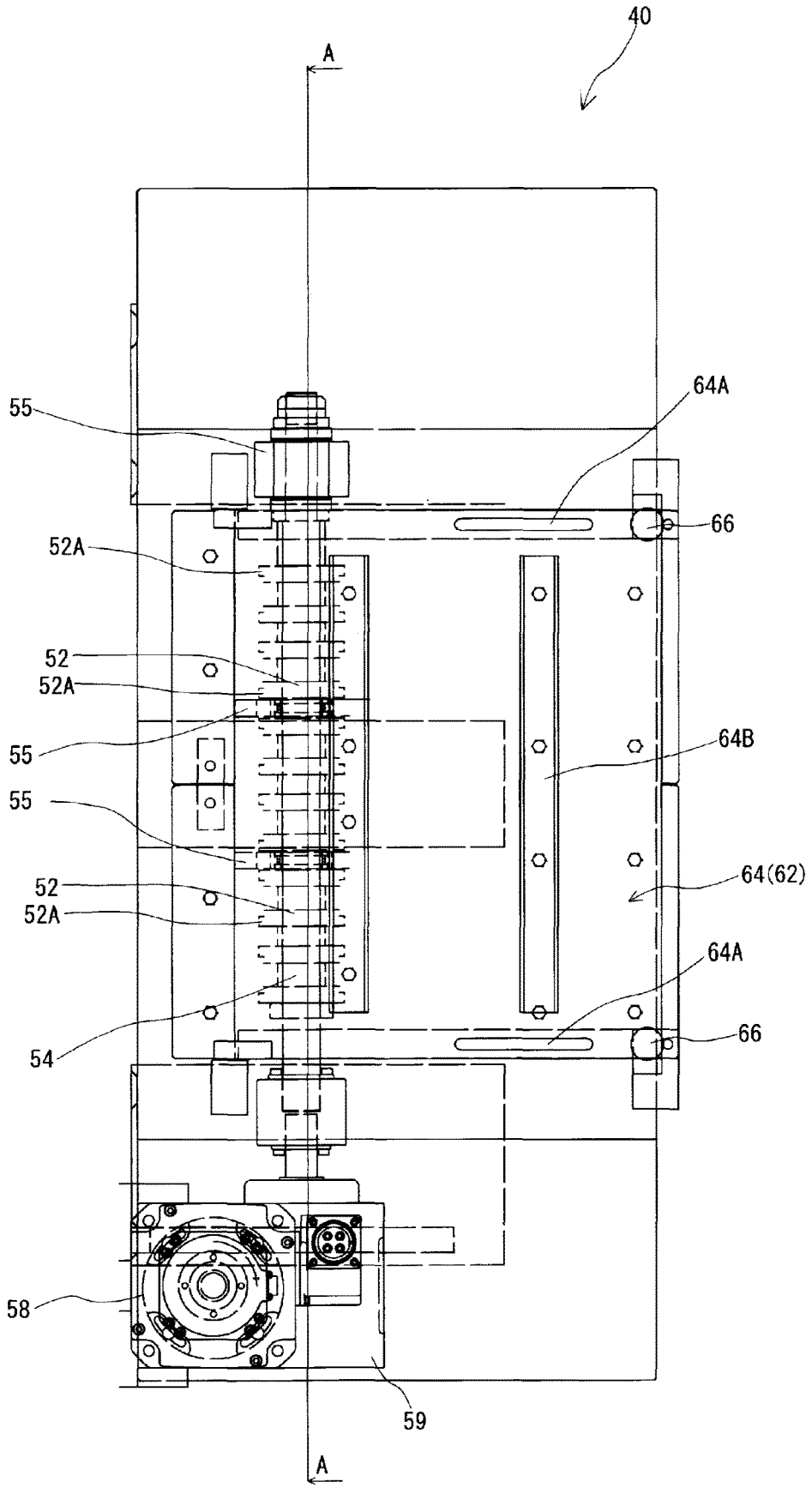
FIG. 4 is a plan view of the conveying apparatus according to the first embodiment.
Figure 5:
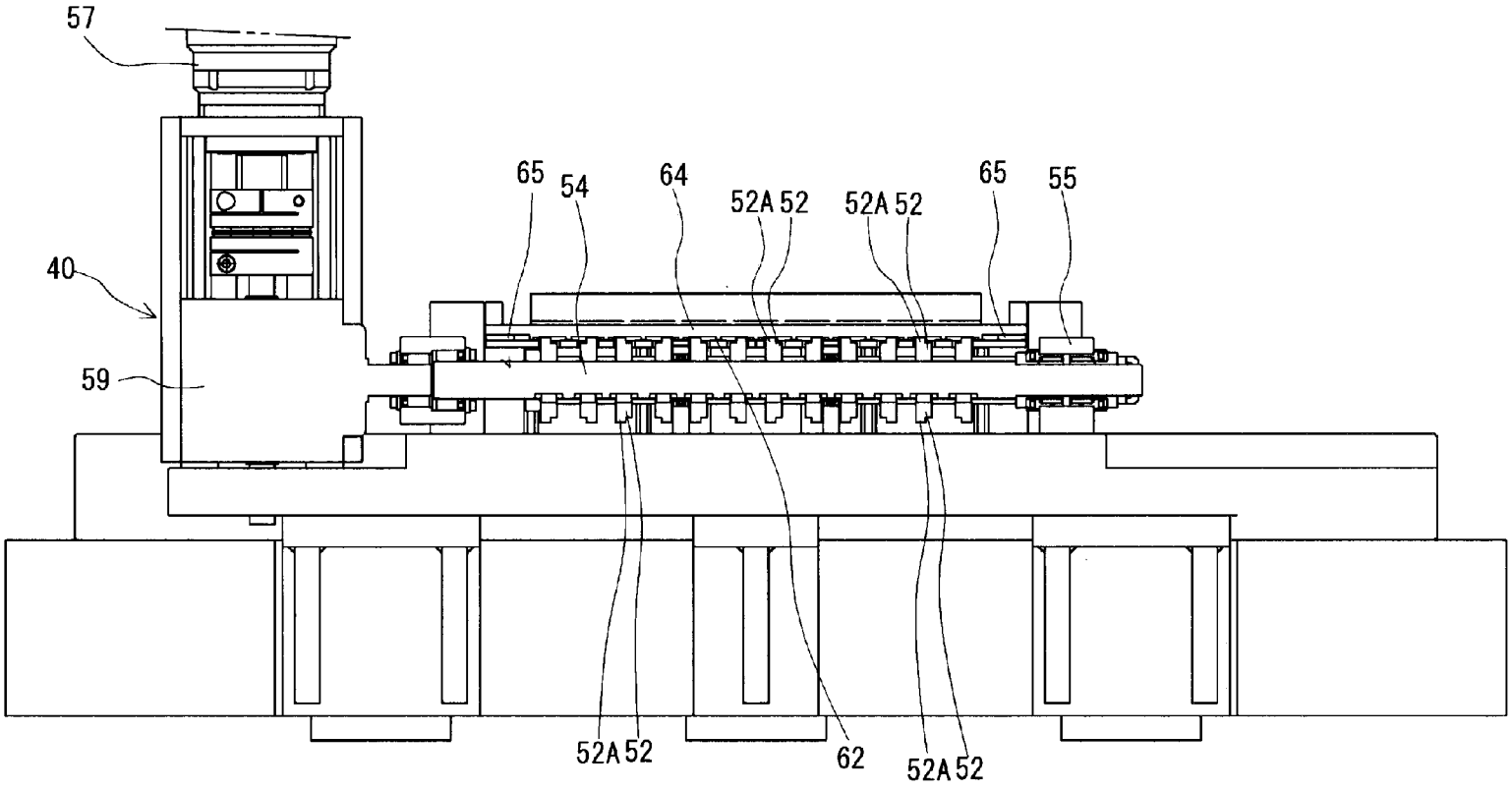
FIG. 5 is a front view (a cross-sectional view along a line A-A in FIG. 4) of the conveying apparatus according to the first embodiment.
Figure 6:
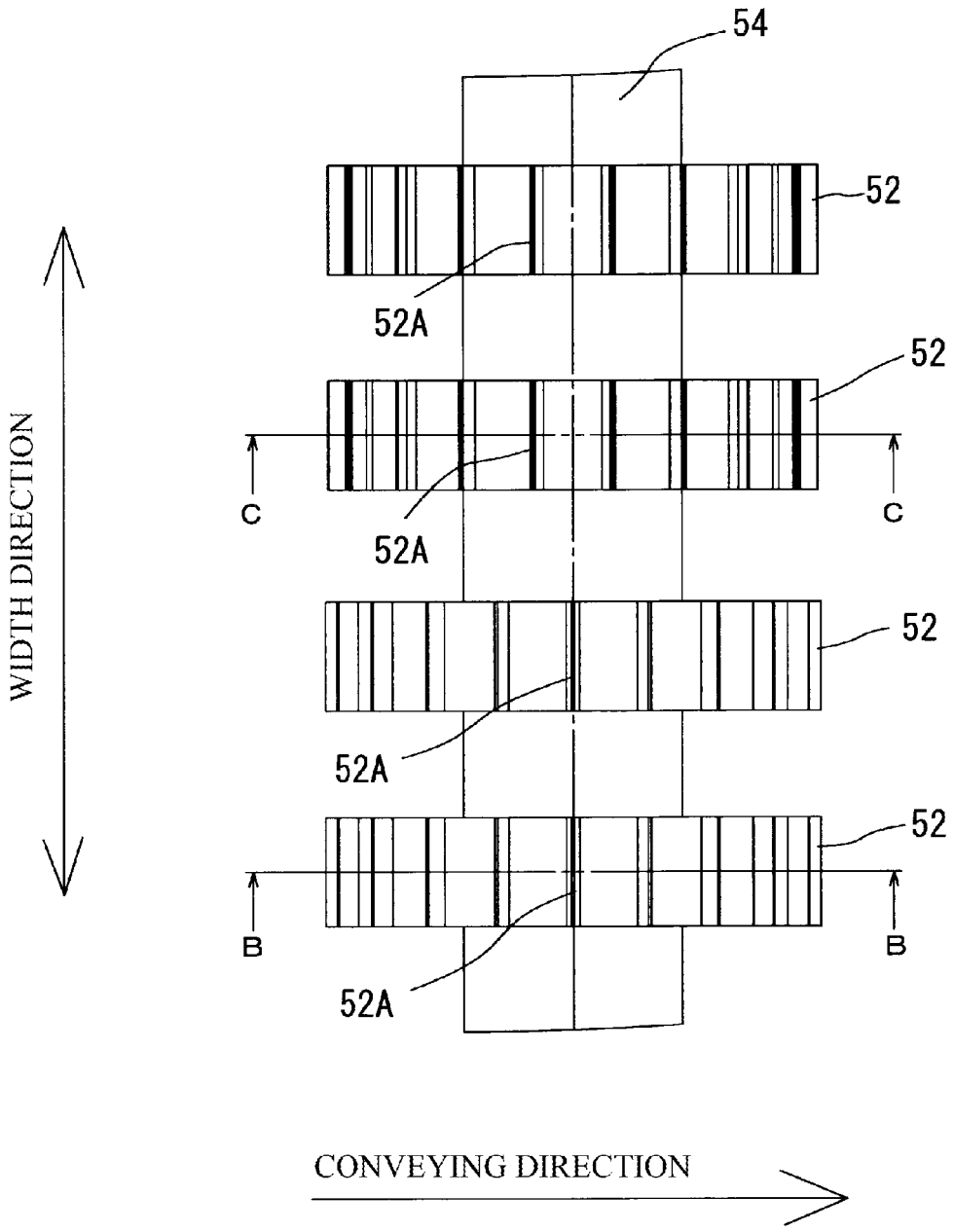
FIG. 6 is a plan view of a rotational shaft and rotating discs.
Figure 7:
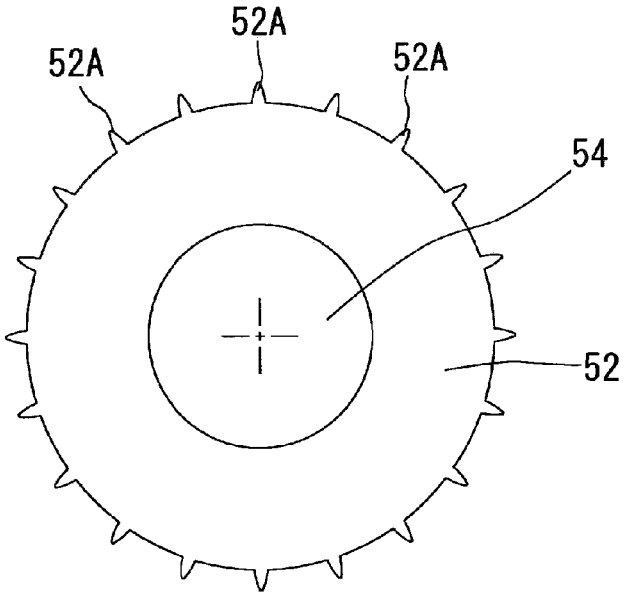
FIG. 7 is a cross-sectional view of a rotating disc along a line B-B.
Figure 8:
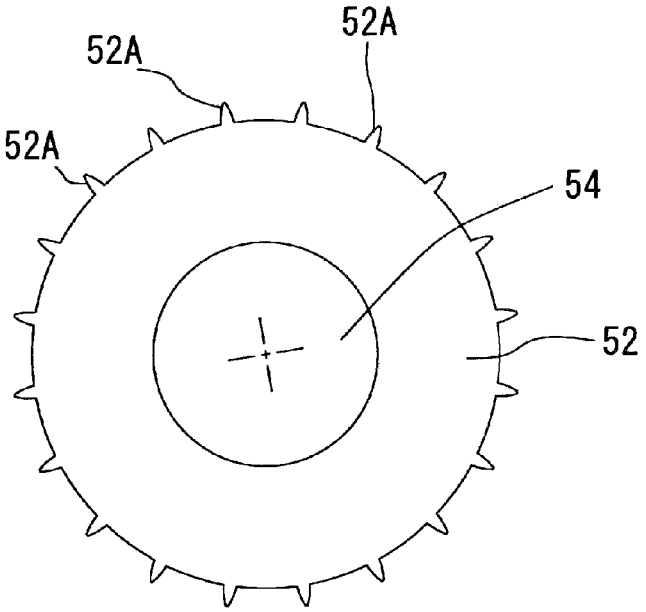
FIG. 8 is a cross-sectional view of a rotating disc along a line C-C.

FIG. 3 is a side view of the conveying apparatus 40, FIG. 4 is a plan view of the conveying apparatus 40, and FIG. 5 is a front view of the conveying apparatus 40. FIG. 6 is a plan view of a rotational shaft 54 and rotating discs 52, and FIGS. 7 and 8 are cross-sectional views of rotating discs 52 taken from the side.

The conveying apparatus 40 according to the present embodiment includes one rotational shaft 54 that extends in the width direction, the rotating discs 52 that are attached to the rotational shaft 54 and have a plurality of protrusions 52A formed on outer circumferential surfaces thereof, and a rotating conveyor driving unit 58 that rotationally drives the rotational shaft 54 around a rotational axis that is perpendicular to the conveying direction of the molded body for heat exchanger fins 30 on the horizontal plane.

A plurality of the rotating discs 52 are provided in the width direction on the rotational shaft 54.

In the present embodiment, the provided number of rotating discs 52 is equal to the number of molded bodies for heat exchanger fins of the product width 30A formed in the width direction on the molded body for heat exchanger fins 30.

Figure 9:
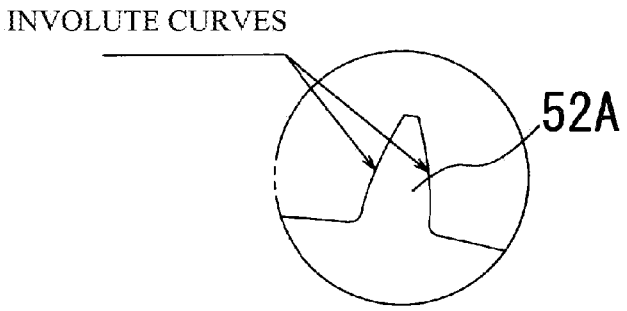
FIG. 9 is an enlargement of a protrusion that is inserted into a tube inserting portion.

FIG. 9 depicts an enlargement of a protrusion 52A.

A plurality of the protrusions 52A are provided on the outer circumferential surface of each rotating disc 52 so as to protrude in the radial direction.

The protrusions 52A are inserted into the tube inserting portions 31 of the molded body for heat exchanger fins 30 and function so as to pull the molded body for heat exchanger fins 30 in the conveying direction due to rotation of the rotational shaft 54.

The protrusions 52A are formed with a so-called "tapered" shape where the upper end portions become gradually narrower as the distance from the outer circumferential surface of the rotating disc 52 (i.e., from the base portions of the protrusions 52A) increases.

The side surfaces of each protrusion 52A are formed so as to be capable of advancing into a tube insertion portion 31 in synchronization with the rotation of the rotational shaft 54 in a state where gaps from the tube insertion portion 31 are maintained and capable of withdrawing from the tube insertion portion 31 while contacting the tube insertion portion 31 to convey the molded body for heat exchanger fins.

In more detail, in the direction of rotation when the rotating discs 52 convey the molded body for heat exchanger fins 30, out of the outer surfaces of each protrusion 52A to be inserted into the tube inserting portions 31, at least a front surface part (that is, the downstream side in the conveying direction of the heat exchanger fins) is formed by involute curves. Note that in FIG. 9, both the front surface and the rear surface out of the outer surfaces of the protrusions 52A are formed by involute curves.

Note also that as the form of the outer surfaces of the protrusions 52A, it is possible to use curves aside from involute curves.

By forming the front surface side out of the outer surfaces of each protrusion 52A using involute curves, when the rotating discs 52 rotate and the protrusions 52A gradually advance inside the tube inserting portions 31, it is possible to reduce the contact resistance between the outer surfaces of the protrusions 52A and inner wall surfaces of the tube inserting portions 31 and have the protrusions 52A advance smoothly.

In addition, also when the protrusions 52A are withdrawn from the tube inserting portions 31 due to the rotation of the rotating discs 52, it is possible to reduce the contact resistance between the outer surfaces of the protrusions 52A and the inner wall surfaces of the tube inserting portions 31 and have the protrusions 52A withdraw smoothly.

The number of protrusions 52A on the plurality of rotating discs 52, the angular intervals at which the protrusions 52A are disposed, and the lengths of the protrusions 52A are all the same. That is, regarding the angles at which the rotating disc 52 are attached onto the singular rotational shaft 54, the rotating discs 52 are attached so that there is a predetermined angular phase difference between the protrusions 52A.

In other words, although a plurality of rotating discs 52 are provided along the axial direction on the rotational shaft 54, the respective rotating discs 52 are provided on the upper surface of the rotational shaft 54 so that the positions of the protrusions 52A differ.

In the present embodiment, four rotating discs 52 are illustrated, and out of these, the two rotating discs 52 on the other side (i.e., the lower side in the drawings) are provided so that the protrusions 52A are be positioned directly above the rotational shaft 54 and the two rotating discs 52 on the one side (i.e., the upper side in the drawings) are provided so that a center position between the two protrusions 52A is positioned there.

By providing the rotating discs 52 in this way, when the molded bodies for heat exchanger fins of the product width 30A have been fed to a position directly above the rotational shaft 54, the protrusions 52A can advance into the tube inserting portions 31 of the pair of molded bodies for heat exchanger fins of the product width 30A on one side and into the pair of molded bodies for heat exchanger fins of the product width 30A on the other side with matching timing.

Here, a value produced by dividing the angular interval at which the protrusions 52A are disposed on the respective rotating discs 52 by the number of groups of rotating discs that have the same angular phase difference should be 14° or below. Since twenty protrusions 52A are provided on one rotating disc 52 in the present embodiment, the angular interval at which the protrusions 52A are disposed is 18°. Also, since there are two pairs of rotating discs with an angular phase difference, this value is two. Accordingly, this gives 18/2=9, which is equal to or below 14°, meaning that the above condition is satisfied.

It has been established from experiments by the applicant that by using the above configuration, before protrusions 52A formed on the rotating discs 52 are completely withdrawn from the tube inserting portions 31, the protrusions 52A of other rotating discs 52 that have a different angular phase difference will advance into the next tube inserting portions 31, which makes it possible to reliably position the molded body for heat exchanger fins 30 and, by doing so, to smoothly convey the molded body for heat exchanger fins 30.

In the present embodiment, a servo motor is used as the rotating conveyor driving unit 58 (hereinafter, the expression "servo motor" is also assigned the reference numeral 58). The servo motor 58 is disposed so that the rotational shaft points downward vertically and the rotational shaft of the servo motor 58 is coupled via a cam index 59 to the rotational shaft 54.

Since the servo motor 58 and the rotational shaft 54 are coupled via the cam index 59 in this way, even when the servo motor 58 is driven at a constant speed, it is still possible to rotationally drive the rotational shaft 54 intermittently.

Here, a cam index 59 with a cam profile that synchronizes to the press operations of the mold pressing unit 20 is used. The output shaft of the cam index 59 is formed with a cam profile that makes it possible to repeatedly execute conveying of a predetermined length of the molded body for heat exchanger fins 30 in an operation in one cycle in accordance with the disposed state of the protrusions 52A provided on the rotating discs 52.

It is also preferable for the cam index 59 to have a cam profile so that at the end of an operation of the manufacturing apparatus for heat exchanger fins 100 in one cycle when intermittently feeding the molded body for heat exchanger fins 30, the insertion angle of the protrusions 52A on any out of the plurality of rotating discs 52 is upright in a direction that is perpendicular to the conveying plane.

By causing the protrusions to advance in an optimal state into the tube insertion portions 31 of the molded body for heat exchanger fins 30 in this way, it is possible to smoothly convey the molded body for heat exchanger fins 30 at the start of conveying. Doing so is also favorable in that it is possible to prevent deformation of the molded body for heat exchanger fins 30.

The servo motor 58 is coupled on one side of the rotating discs 52, and the other end is held in a rotatable state by a holder 55, as represented by a bearing holder or the like.

The servo motor 58 is coupled to the rotational shaft 54 (the output shaft of the servo motor) via a reducer 57 and the cam index 59 in a state where the servo motor 58 is offset to the upstream side in the conveying direction of the axis position of the center axis (rotational axis) of the rotational shaft 54 (note that the servo motor 58 may alternatively be offset to the downstream side in the conveying direction).

Regarding the coupling of the servo motor 58 and the rotational shaft 54 in the conveying apparatus 40, aside from a configuration where the servo motor 58 is coupled to the rotational shaft 54 via the reducer 57 and the cam index 59 as in the present embodiment, it is also possible to use a configuration where the servo motor 58 is coupled to the rotational shaft 54 via only the cam index 59, a configuration where the servo motor 58 is coupled to the rotational shaft 54 via only the reducer 57, and a configuration where the output shaft of the servo motor 58 is directly coupled to the rotational shaft 54.

That is, there are no particular limitations on how the rotational shaft 54 and the servo motor 58 are coupled.

In addition, the rotational driving operations of the servo motor 58 are controlled by the operation control unit 90 so as to synchronize to (i.e., the rotational speed is synchronized with) the press operations of the mold pressing unit 20 (i.e., the intermittent feeding operations of the molded body for heat exchanger fins 30).

Figure 10:
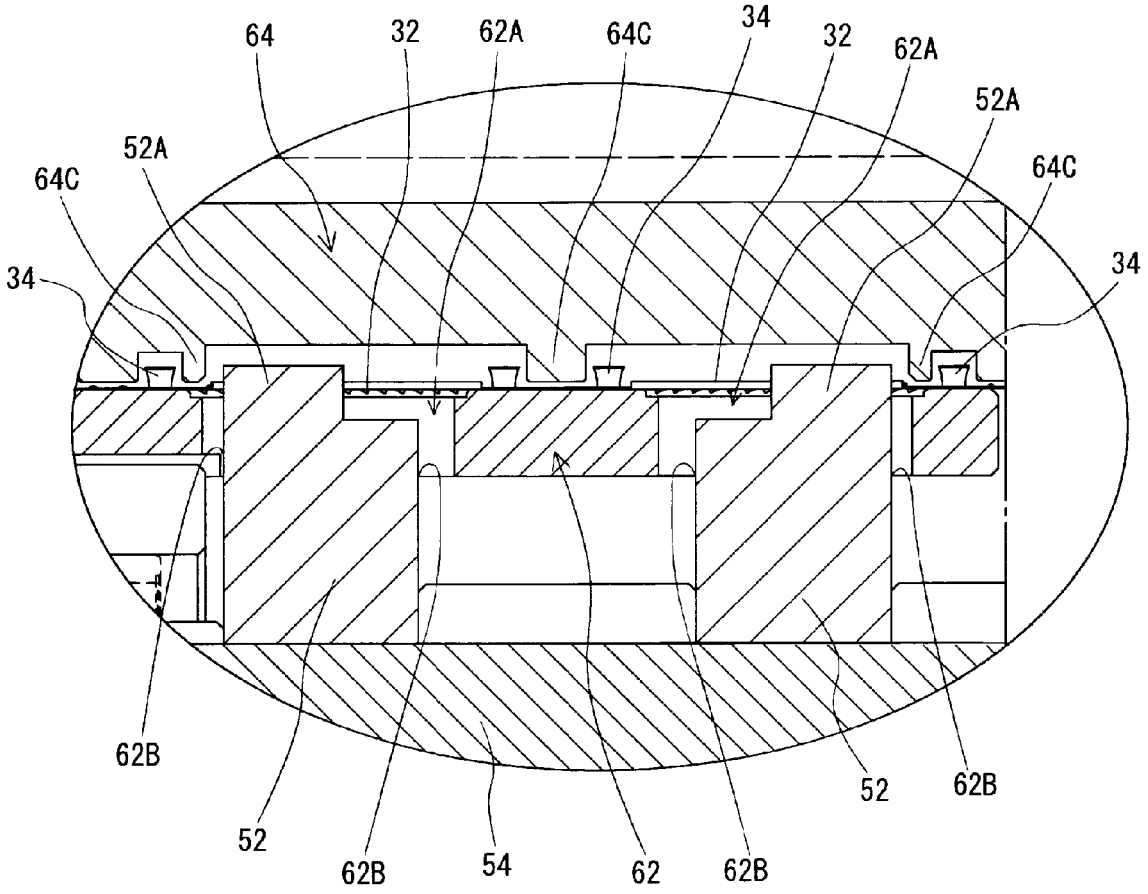
FIG. 10 is an enlargement of a principal part of FIG. 5.
Figure 11:
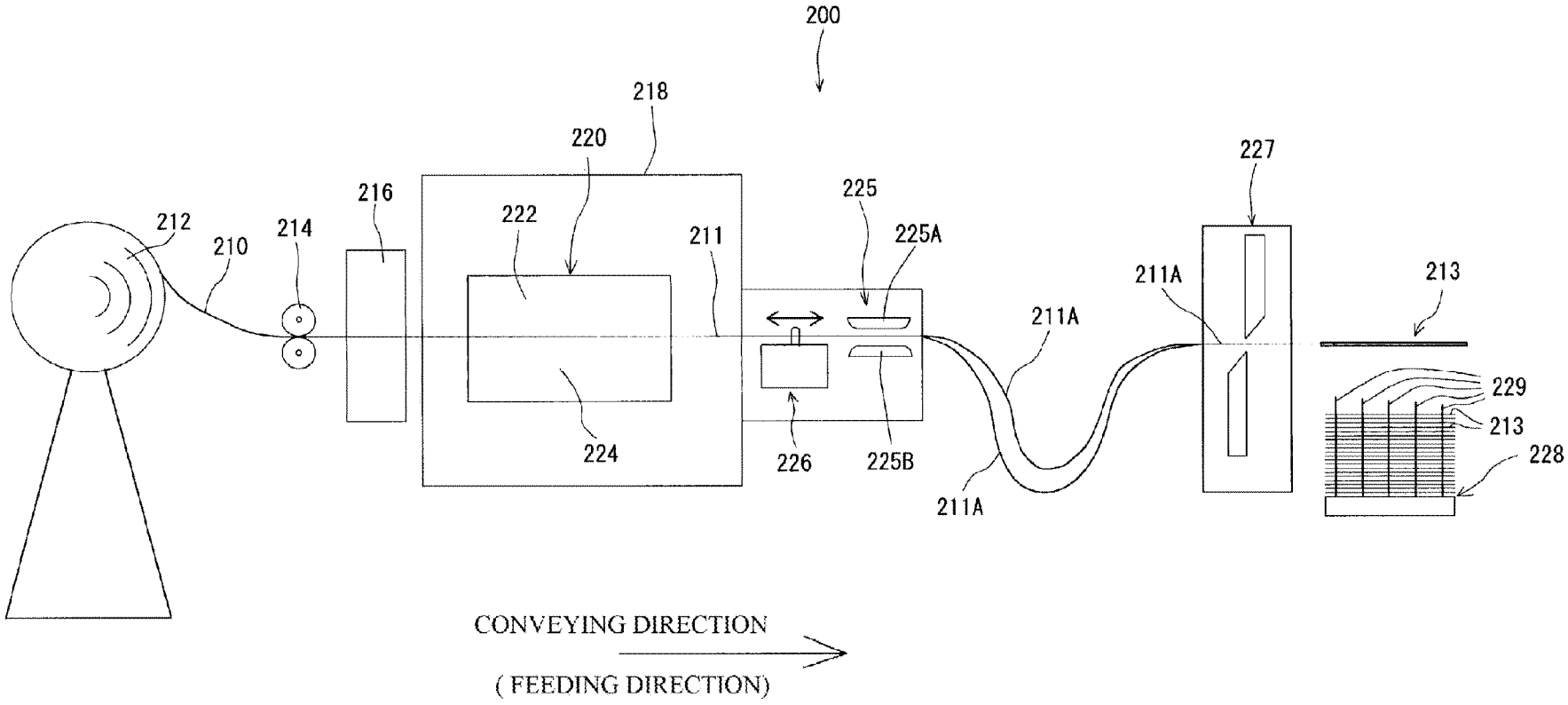
FIG.11 PRIOR ART
FIG. 11 is a side view of a manufacturing apparatus for heat exchanger fins according to the background art.

Also, as depicted in FIG. 10, in the present embodiment, a lower guide plate 62, which performs guiding (i.e., supports the lower surface of the molded body for heat exchanger fins 30) so that a lower surface height position of the molded body for heat exchanger fins 30 is at the same height position across a range of a required length, is disposed at an exit position of the mold pressing unit 20.

Concave channels 62A are formed in the upper surface of the lower guide plate 62 in the present embodiment. The concave channels 62A of the lower guide plate 62 are formed at positions that correspond to the formation positions of the tube insertion portions 31 in the molded body for heat exchanger fins 30 and at positions that correspond to the formation positions of the louvers 32.

Through-holes 62B that pass through in the thickness direction are formed in the concave channels 62A of the lower guide plate 62 and the rotating discs 52 are housed in a state where parts of the protrusions 52A (the rotating discs 52) protrude through the through-holes. The front end parts of the protrusions 52A are provided so that when the protrusions 52A are upright with respect to the conveying plane (i.e., when the intermittent feeding operation in one cycle of the molded body for heat exchanger fins 30 has ended), the front ends are positioned higher than the upper surface height of the lower guide plate 62.

The concave channels 62A are formed at positions corresponding to the disposed positions of the louvers 32 formed in the molded body for heat exchanger fins 30, which prevents contact between the lower guide plate 62 and the louvers 32 when the molded body for heat exchanger fins 30 is conveyed.

An upper guide plate 64 is disposed above the lower guide plate 62 so as to be capable of covering the upper surface of the molded body for heat exchanger fins 30.

The upper guide plate 64 is provided so as to be switchable (rotatable) between a state where the upper guide plate 64 is placed over the lower guide plate 62 and a state where the upper guide plate 64 is lifted up, with an edge portion on the mold pressing unit 20 side as the axis of rotation. During normal conveying of a molded body for heat exchanger fins 30, the upper guide plate 64 is placed over the lower guide plate 62 in a state where there is a predetermined gap in the thickness direction. This gap is formed by spacers 65 disposed between the lower guide plate 62 and the upper guide plate 64.

A handle 64A and a reinforcing member 64B are attached to an upper surface of the upper guide plate 64. By having the operator grasp and lift up the handle 64A, it is possible to place the upper guide plate 64 in a state where the upper guide plate 64 is lifted up from the lower guide plate 62.

Convex portions 64C that project downward are disposed on the lower surface of the upper guide plate 64 at positions that correspond to the flat parts of the molded body for heat exchanger fins 30. The convex portions 64C are provided so that in a normal state, gaps are formed between the convex portions 64C and the flat parts of the molded body for heat exchanger fins 30.

Guide plate pressing bolts 66 that fix the upper guide plate 64 and the lower guide plate 62 are also provided. In a state where the spacers 65 are disposed between the lower guide plate 62 and the upper guide plate 64, the lower guide plate 62 and the upper guide plate 64 are attached in a state where the plates are fastened by the guide plate pressing bolts 66.

When (only when) variations (fluctuations) occur in the thickness direction of the molded body for heat exchanger fins 30 discharged from the mold pressing unit 20, such fluctuations in the molded body for heat exchanger fins 30 are regulated by the convex portions 64C of the upper guide plate 64 contacting the flat parts of the molded body for heat exchanger fins 30. By doing so, fluctuations in the insertion depth of the protrusions 52A into the tube insertion portions 31 of the molded body for heat exchanger fins 30 are suppressed, and it is possible to keep the height of the conveying plane of the molded body for heat exchanger fins 30 at a predetermined height. Since this regulation of fluctuations in the thickness direction of the molded body for heat exchanger fins 30 is achieved by the convex portions 64C contacting the flat parts of the molded body for heat exchanger fins 30, deformation of the molded body for heat exchanger fins 30 does not occur.

The inter-row slit apparatus 70 is provided downstream of the conveying apparatus 40. The inter-row slit apparatus 70 includes upper blades 72 that are disposed on the upper surface side of the molded body for heat exchanger fins 30 and lower blades 74 that are disposed on the lower surface side of the molded body for heat exchanger fins 30.

Although the power source of the inter-row slit apparatus 70 may be an independently provided power source, it is also possible to drive the inter-row slit apparatus 70 using the up-down operations of the mold pressing unit 20. The upper blades 72 and the lower blades 74 of the inter-row slit apparatus 70 are formed so as to be elongated in the conveying direction, and by cutting the molded body for heat exchanger fins 30 that is intermittently conveyed with the upper blades 72 and the lower blades 74 that come together, the molded bodies for heat exchanger fins of the product width 30A that are preforms for products that are elongated in the conveying direction are formed. Although the inter-row slit apparatus 70 is disposed on a downstream side of the conveying apparatus 40 here, the inter-row slit apparatus 70 may be disposed at a position upstream of the conveying apparatus 40.

The plurality of molded bodies for heat exchanger fins of the product width 30A that have been cut to the product width by the inter-row slit apparatus 70 are fed inside a cutoff apparatus 80 where the respective molded bodies for heat exchanger fins of the product width 30A are cut into predetermined lengths. By doing so, it is possible to obtain heat exchanger fins 30B that are the final products. A plurality of heat exchanger fins 30B are stacked on top of each other in a stacker apparatus 82, and when a predetermined number of heat exchanger fins 30B have been stacked, the heat exchanger fins 30B are conveyed to a next process where a heat exchanger, not illustrated, is assembled.

The manufacturing apparatus for heat exchanger fins 100 according to the present embodiment has the operation control unit 90 which includes a CPU and a storage unit, neither of which is illustrated. An operation control program for operation control of the various configurations that construct the manufacturing apparatus for heat exchanger fins 100 is stored in advance in the storage unit of the operation control unit 90, with the CPU reading out the operation control program from the storage unit and performing operation control of the various configurations in accordance with the operation control program. By performing operation control of the various configurations using the CPU and the operation control program in this way, it is possible to coordinate a series of operations of the various configurations of the manufacturing apparatus for heat exchanger fins 100.

The operation control unit 90 controls the operation of the rotating conveyor driving unit 58 so as to synchronize the rotation operations of the rotational shafts 54 and to also synchronize with the rotation of the crank shaft (not illustrated) of the mold pressing unit 20. When one cycle (i.e., the operation in one cycle) of intermittent feeding of the molded body for heat exchanger fins 30 has ended, the protrusions 52A of one of the rotating discs 52 will be upright with respect to the conveying plane of the molded body for heat exchanger fins 30 in a direction that is perpendicular to the conveying plane. More specifically, the output shaft of the cam index 59 and the rotational shaft 54 are coupled so as to produce a state where the positions of the protrusions 52A of the rotating discs 52 are upright at an operation start position of an intermittent operation (one cycle operation) of the cam index 59.

In addition, although a configuration has been described where the insertion angle of the protrusions 52A that advance into the tube insertion portions 31 of the molded body for heat exchanger fins 30 is upright and perpendicular to the conveying plane when the operation in one cycle of intermittent feeding of the molded body for heat exchanger fins 30 of the manufacturing apparatus for heat exchanger fins 100 ends, the present invention is not limited to this configuration. The insertion angle of the protrusions 52A into the tube insertion portions 31 of the molded body for heat exchanger fins 30 may be set by calculating in advance, in keeping with the material and thickness of the molded body for heat exchanger fins 30, a range of angles where there is no deformation of the tube insertion portions 31 due to the restarting of rotational driving of the protrusions 52A when conveying of the molded body for heat exchanger fins 30 restarts, and then setting the insertion angle in this calculated range of angles.

It is also possible to use a configuration where the cam indexes 59 is not interposed when coupling the rotational shaft 54 and the rotating conveyor driving unit 58 and the operation control unit 90 instead performs operation control of the rotating conveyor driving unit 58 so that pressing operations by the mold pressing unit 20 (i.e., intermittent feeding operations of the molded body for heat exchanger fins 30) and rotational driving operations of the rotating conveyor driving unit 58 are synchronized.

In the embodiments described earlier, the tube inserting portions 31 are described as being cutaway portions.

However, it is also possible to apply the present invention to so-called "round tube" type heat exchanger fins where the tube inserting portions 31 are through-holes.

It is also possible to configure a manufacturing apparatus for heat exchanger fins 100 by appropriately combining all of the embodiments and modifications described above.

What is claimed is:

1. A manufacturing apparatus for heat exchanger fins that manufactures heat exchanger fins which have a plurality of through-holes or a plurality of cutaway portions, into which heat exchanger tubes are to be inserted, formed along a length direction thereof, the manufacturing apparatus comprising:

a mold apparatus that forms, in a thin plate made of metal, a molded body for heat exchanger fins which has a plurality of heat exchanger fins, in which the plurality of through-holes or the plurality of cutaway portions have been formed, formed in a width direction;

a conveying apparatus that conveys the molded body for heat exchanger fins in a conveying direction; and an inter-row slit apparatus that cuts the molded body for heat exchanger fins along the conveying direction to produce molded bodies for heat exchanger fins of a product width, wherein the mold apparatus is provided so as to form, in the molded body for heat exchanger fins to be formed in the thin plate made of metal, the molded body for heat exchanger fins so that the plurality of through-holes or the plurality of cutaway portions have different positions in the conveying direction for each molded body for heat exchanger fins of the product width, the conveying apparatus is provided with a single rotational shaft that extends in the width direction that is perpendicular to the conveying direction on a horizontal plane, has a plurality of rotating discs that have a plurality of tapered protrusions, which are capable of advancing into the plurality of through-holes or the plurality of cutaway portions, formed on an outer circumferential surface thereof provided on the rotational shaft along an axial direction of the rotational shaft so that a number of the rotating discs is equal to a number of the molded bodies for heat exchanger fins of the product width, and includes a rotational driving unit that rotationally drives the rotational shaft, positions of the plurality of tapered protrusions on different rotating discs of the plurality of rotating discs have a predetermined angular phase difference so that the plurality of tapered protrusions advance into the plurality of through-holes or the plurality of cutaway portions when the plurality of through-holes or the plurality of cutaway portions of the molded bodies for heat exchanger fins of the product width, for which the positions in the conveying direction of the plurality of through-holes or the plurality of cutaway portions differ, are disposed directly above the rotational shaft, a lower guide plate supporting a lower surface of the molded bodies for heat exchanger fins and an upper guide plate covering an upper surface of the molded bodies for heat exchanger fins are provided, and convex portions are downwardly projected from a lower surface of the upper guide plate and located at positions corresponding to flat parts of the molded bodies for heat exchanger fins, and the convex portions contact the flat parts of the molded bodies for heat exchanger fins when fluctuations of the molded bodies for heat exchanger fins, in a thickness direction, occur.

2. The manufacturing apparatus for heat exchanger fins according to claim 1, wherein during intermittent feeding of the molded body for heat exchanger fins, when the rotational driving unit has completed an operation in one cycle, the plurality of tapered protrusions are inserted in a direction perpendicular to a conveying plane at least one position out of the plurality of through-holes or the plurality of cutaway portions of the molded body for heat exchanger fins.

3. The manufacturing apparatus for heat exchanger fins according to claim 2, wherein a value produced by dividing an angular interval at which the plurality of tapered protrusions is disposed on each rotating disc by a number of groups of rotating discs that have a same angular phase difference is no greater than 14 degrees.

4. The manufacturing apparatus for heat exchanger fins according to claim 1, wherein a value produced by dividing an angular interval at which the plurality of tapered protrusions is disposed on each rotating disc by a number of groups of rotating discs that have a same angular phase difference is no greater than 14 degrees.

* * * * *